US006098505A

United States Patent [19]

Chang

[11] Patent Number: 6,098,505

[45] Date of Patent: Aug. 8, 2000

[54] ADJUSTABLE WRENCH

[76] Inventor: Jong-Shing Chang, No. 5, Chang Ma Street, Ma Hsing Village, Shiow Shoei Shi, Chang Huah, Taiwan

[21] Appl. No.: 09/207,418

[22] Filed: Dec. 8, 1998

[51] Int. Cl.[7] ..... B25B 13/16

[52] U.S. Cl. ..... 81/166

[58] Field of Search ..... 81/155, 165, 166, 81/168, 175

[56] References Cited

U.S. PATENT DOCUMENTS

| | | | |
|---|---|---|---|
| 1,160,494 | 11/1915 | Bush | 81/165 |
| 3,640,159 | 2/1972 | Halls et al. | 81/165 |
| 4,838,132 | 6/1989 | Pyles | 81/166 |
| 4,903,557 | 2/1990 | Jeremic | 81/166 |
| 5,331,868 | 7/1994 | Elmore | 81/165 |

FOREIGN PATENT DOCUMENTS

| | | | |
|---|---|---|---|
| 46474 | 11/1932 | Denmark | 81/166 |
| 872637 | 6/1942 | France | 81/155 |
| 5900 | of 1882 | United Kingdom | 81/175 |

*Primary Examiner*—David A. Scherbel
*Assistant Examiner*—Joni B. Danganan
*Attorney, Agent, or Firm*—Browdy and Neimark

[57] ABSTRACT

An adjustable wrench has a handle and a jaw head extending from one end of the handle. The jaw head is formed of a fixed jaw and a movable jaw. The fixed jaw is composed of a first clamping side, a second clamping side, a third clamping side, and a fourth clamping side. A receiving hole is formed by these four clamping sides and provided with an opening. The movable jaw is axially and linearly displaceable in the receiving hole of the fixed jaw such that the movable jaw is capable of an axial and linear displacement. The movable jaw has a first clamping side and a second clamping. The fixed jaw and the movable jaw form together a jaw mouth having at least three clamping sides to hold securely a hexagonal nut or a bolt having a hexagonal head.

5 Claims, 4 Drawing Sheets

ADJUSTABLE WRENCH

FIELD OF THE INVENTION

The present invention relates generally to a wrench, and more particularly to an adjustable wrench provided with means to prevent its movable jaw from moving aside at the time when the adjustable wrench is at work.

BACKGROUND OF THE INVENTION

As shown in FIG. 1, an adjustable wrench of the prior art has a fixed jaw 1 and a movable jaw 2. A mouth 3 is formed between the fixed jaw 1 and the movable jaw 2 such that the size of the mouth 3 is adjusted by the movable jaw 2.

Such a prior art adjustable wrench as described above is defective in design in that the movable jaw 2 is prone to move aside at the time when a nut or the head of a bolt is held and turned in the mouth 3. The mouth 3 has an open end. Certain adjustable wrenches of the prior art have a closed mouth, a handle, and a jaw head. The jaw head is provided longitudinally with a receiving hole. The jaw head is further provided axially with a round hole for pivoting an adjustment bolt capable of axial and linear motion. The planar portion of the front end of the adjustment bolt is used as a movable clamping surface for holding a nut or bolt in conjunction with the left side and the right side of the jaw head. The planar portion of the front end of the adjustment bolt is vulnerable to moving aside when it is rotated to make an axial displacement. As a result, the nut or bolt can not be securely held by the movable clamping surface.

SUMMARY OF THE INVENTION

It is therefore the primary objective of the present invention to provide an adjustable wrench which is provided with at least three clamping sides between the movable jaw and the fixed jaw, thereby enabling the adjustable wrench to hold securely a nut or bolt.

It is another objective of the present invention to provide an adjustable wrench with means to confine the axial displacement of the movable jaw so as to enhance the holding effect of the adjustable wrench.

In keeping with the principle of the present invention, the foregoing objectives of the present invention are attained by an adjustable wrench having a handle and a jaw head extending from one end of the handle. The jaw head has a fixed jaw and a movable jaw. The fixed jaw consists of a first clamping side, a second clamping side, a third clamping side connected with and perpendicular to the second clamping side, and a fourth clamping side parallel to the first clamping side. A receiving hole is formed by these clamping sides and provided with a mouth. The movable jaw is axially and linearly displaceable in the receiving hole such that the movable jaw is capable of axial and linear displacement. The movable jaw has a first clamping side and a second clamping side forming an angle of 120 degrees along with the first clamping side. The first and the second clamping sides of the fixed jaw and the movable jaw are located so that a nut or bolt can be securely held by the clamping sides of the fixed jaw and the clamping sides of the moveable jaw. The fixed jaw and the movable jaw form a jaw mouth with at least three clamping sides to facilitate the holding of a hexagonal nut or a bolt having a hexagonal head.

The foregoing objectives, features, functions and advantages of the present invention will be more readily understood upon a thoughtful deliberation of the following detailed description of three preferred embodiments of the present invention with reference to the accompanying drawings.

DETAILED DESCRIPTION OF THE INVENTION

Figure 1:
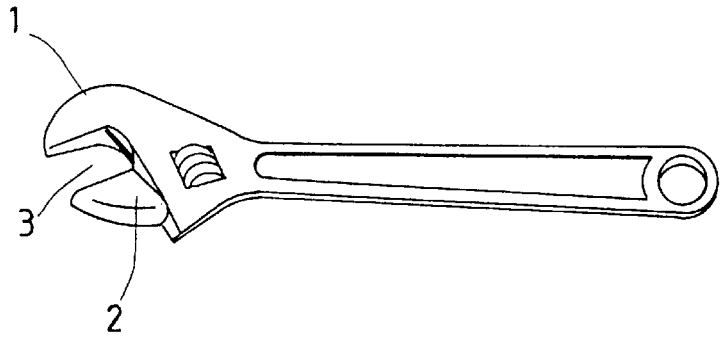
FIG. 1 PRIOR ART
FIG. 1 shows a perspective view of an adjustable wrench of the prior art.
Figure 2:
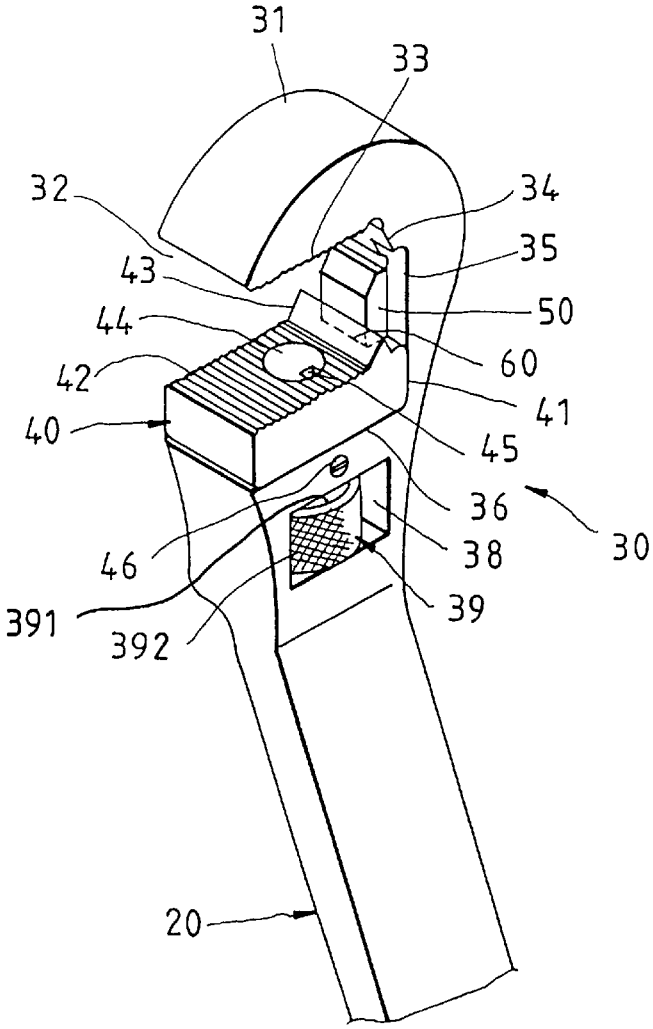
FIG. 2 shows a perspective view of a first preferred embodiment of the present invention.

As shown in FIG. 2, an adjustable wrench one embodiment of in the present invention is composed of a handle 20 and a jaw head 30 formed integrally at one end of the handle 20 such that the axial direction of the jaw head 30 and the axial direction of the handle 20 form an angle of 15 degrees or so to facilitate the application of force on the wrench.

The jaw head 30 has a fixed jaw 31 and a movable jaw 40. The fixed jaw 31 is provided with a receiving hole 32 having an open end. The receiving hole 32 is provided in the periphery thereof with a first clamping side 33, a second clamping side 34 forming an angle of 120 degrees with the first clamping side 33, a third clamping side 35 connected with the second clamping side 34, and a fourth clamping side 36 located at the bottom side of the third clamping side 35 such that the fourth clamping side 36 is parallel to the first clamping side 33. The first clamping side 33 is provided with a serrated surface for enhancing the clamping effect. The third clamping side 35 is provided with a guide portion 50, which is a protruded portion extending from the third clamping side 33 toward the open end of the receiving hole 32. The fourth clamping side 36 is provided with a through hole 37 extending along the direction of the axis thereof. Located between the handle 20 and the fourth clamping side 36 is a slot hole 38 coaxial with the through hole 37 and in communication with the through hole 37. A rotary knob 39 is received in the slot hole 38. The rotary knob 39 has a center threaded hole 391. The outer peripheral surface of the knob body is provided with a knurled surface 392 for increasing the contact friction to facilitate the turning of the rotary knob 39 with a thumb.

The movable jaw 40 is disposed in the receiving hole 32 and provided with a first clamping side 42 and a second clamping side 43 forming an angle of 120 degrees along with the first clamping side 42. The first and the second clamping sides 42 and 43 of the movable jaw 40 and the first and the second clamping sides 33 and 34 of the fixed jaw 31 constitute a jaw mouth having at least three clamping sides for holding a hexagonal nut or a bolt having a hexagonal head. The first clamping side 42 of the movable jaw 40 is provided with a serrated surface for enhancing the clamping effect. The second clamping side 43 has a side 41 for joining with the third clamping side 35 of the fixed jaw 31. The side 41 is provided with a position confining portion 60 which is in fact a recessed portion corresponding to the guide portion 50 of a protruded construction and engageable with the guide portion 50. The movable jaw 40 has a bolt shank 44 located at the center of the lower end of the movable jaw 40.

The bolt shank 44 is put through the through hole 37 of the fixed jaw 31 and the center threaded hole 391 of the rotary knob 39. The bolt shank 44 is provided with a slot 45 extending in the direction of an axis of the bolt shank 44. A locating pin 46 is fastened onto the wall located between the fourth clamping side 36 of the fixed jaw 31 and the slot hole 38 such that the inner end of the locating pin 46 is extended into and retained in the slot 45. When the rotary knob 39 is turned, the bolt shank 44 is actuated to move linearly in the through hole 37, thereby enabling the movable jaw 40 to slide up and down in the receiving hole 32 so as to adjust the size of the jaw mouth.

Figure 3:
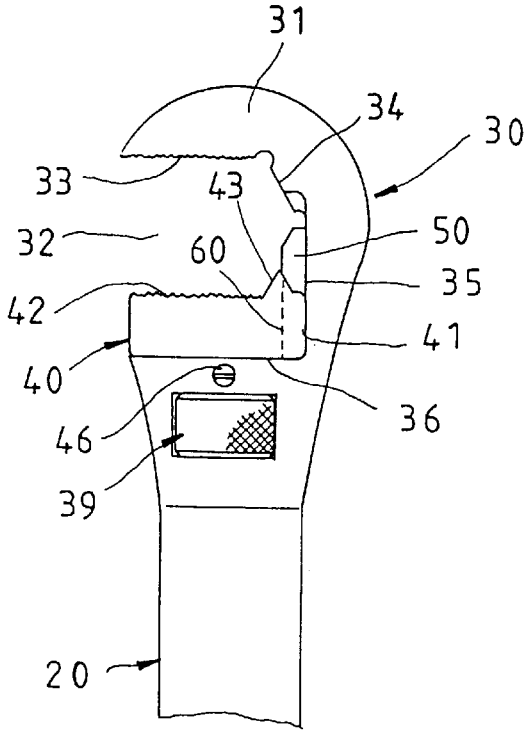
FIG. 3 shows a schematic view of the first preferred embodiment of the present invention at work.
Figure 4:
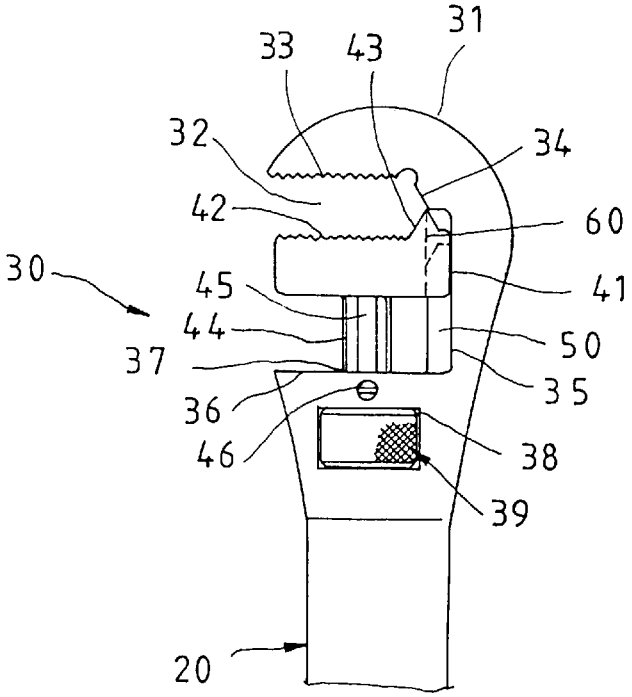
FIG. 4 shows another schematic view of the first preferred embodiment of the present invention at work.

Now referring to FIGS. 3 and 4, the operation of the present invention involves a first step in which a hexagonal nut or bolt is held in the receiving hole 32. The rotary knob 39 is then rotated by a thumb to actuate the bolt shank 44 to move the movable jaw 40 forward or backward until such time when the nut or bolt is securely held by the clamping sides 33 and 34 of the fixed jaw 31 in conjunction with the clamping sides 42 and 43 of the movable jaw 40. The nut or bolt can be finally fastened or unfastened by turning the handle 20 in a predetermined direction. The displacement of the movable jaw 40 takes place along the guide portion 50 to prevent the movable jaw 40 from moving aside. In addition, when the movable jaw 40 is moved, the movable jaw 40 is braced by the bolt shank 44. In the meantime, the side 41 of the movable jaw 40 is in contact with the third clamping side 35 of the fixed jaw 31 such that a recessed portion 60 of the side 41 receives the protruded guide portion 50 of the fixed jaw 31. The operation of the adjustable wrench of the present invention is further made easy by a greater contact area between the nut, the movable jaw 40 and the fixed jaw 31.

Figure 5:
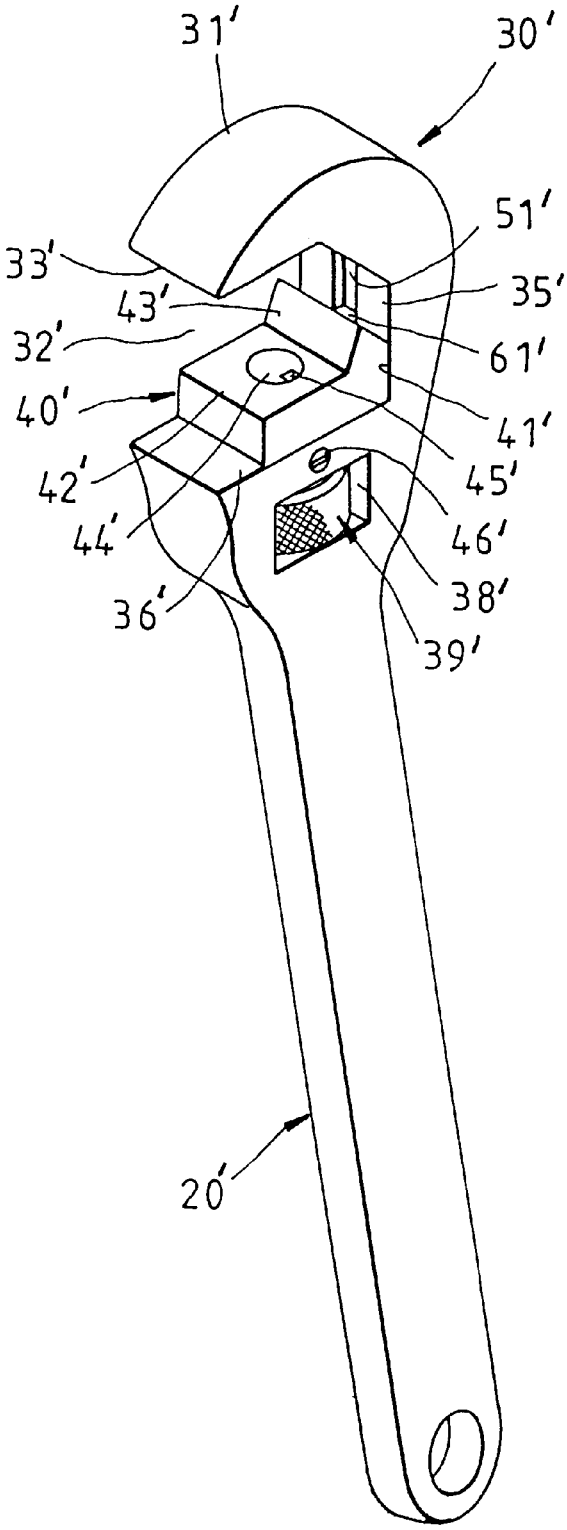
FIG. 5 shows a perspective view of a second preferred embodiment of the present invention.
Figure 6:
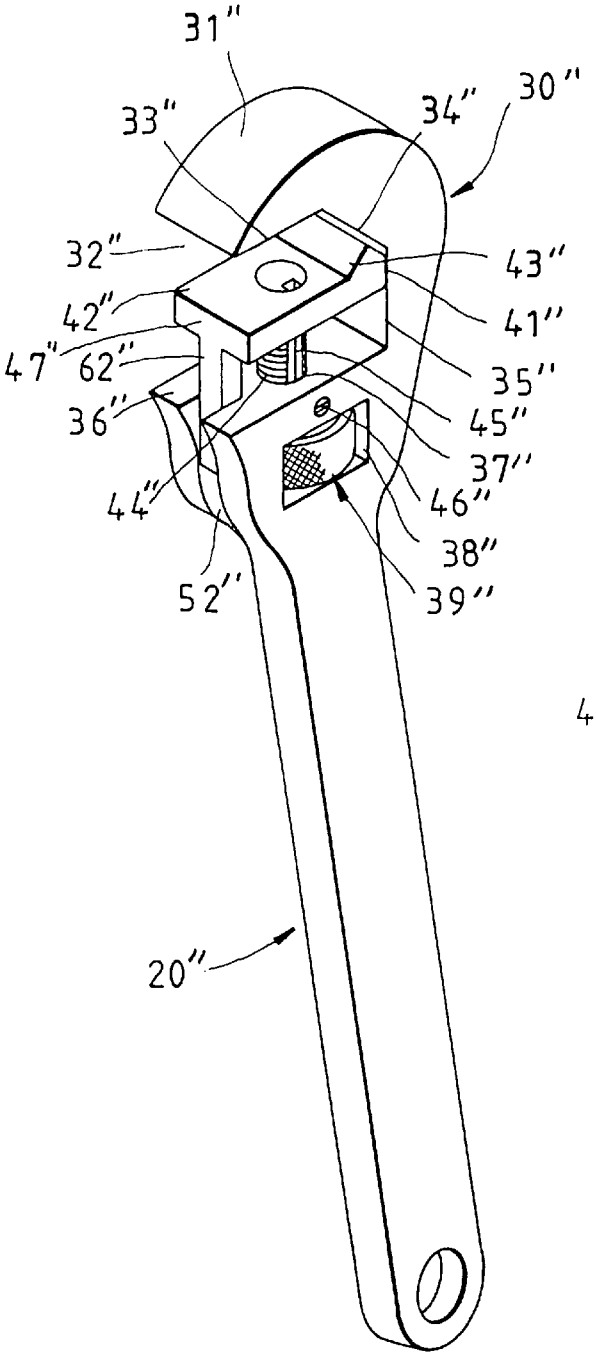
FIG. 6 shows a perspective view of a third preferred embodiment of the present invention.
Figure 7:
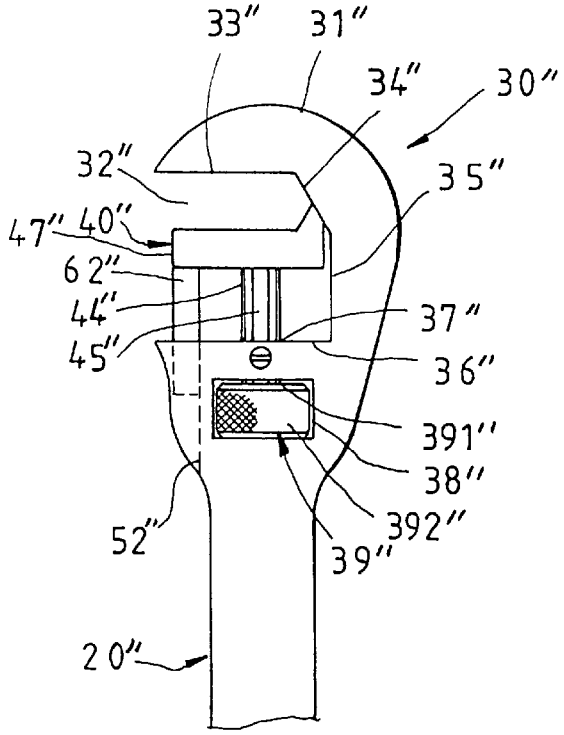
FIG. 7 shows a schematic view of the third preferred embodiment of the present invention at work.

The embodiment of the present invention described above is to be deemed in all respects as being merely illustrative and not restrictive. Accordingly, the present invention may be embodied in other specific forms without deviating from the spirit thereof. For example, the second preferred embodiment of the present invention consists of a fixed jaw 31' which is provided with the third clamping side 35' having a guide portion 51 of a recessed construction rather than a protruded construction, as shown in FIG. 5. In the meantime, the side 41' of the second clamping side 43' of the movable jaw 40' is provided with a position confining portion 61 of a protruded construction rather than a recessed construction. As the movable jaw 40' is moved, the position confining portion 61 of the movable jaw 40' slides in the guide portion 51 of the fixed jaw 31'. Moreover, as shown in FIGS. 6 and 7, the guide portion 52 of the fixed jaw 31" of the third preferred embodiment is a slide slot and located in the fourth clamping side 36". In the meantime, the position confining portion 62 of the movable jaw 40" of the third preferred embodiment is a rail which is located in the side 47 of the first clamping side 42" of the movable jaw 40". As the movable jaw 40 is moved, the rail 62 of the movable jaw 40" slides in the slide slot 52 of the fixed jaw 31". The present invention is therefore to be limited only by the scopes of the following appended claims.

What is claimed is:

1. An adjustable wrench comprising:

a handle;

at least one jaw head extending from one end of said handle and having a fixed jaw and a movable jaw, said fixed jaw consisting of a first clamping side, a second clamping side forming an angle of 120 degrees with said first clamping side, a third clamping side connected with said second clamping side, a fourth clamping side parallel to said first clamping side, and a receiving hole formed by all of said clamping slides and provided with an opening, said movable jaw being axially and linearly displaceable in said receiving hole of said fixed jaw such that said movable jaw slides axially and linearly, said movable jaw having a first clamping side parallel to said first clamping side of said fixed jaw, said movable jaw further having a second clamping side forming an angle of 120 degrees with respect to the first clamping side of the moveable jaw; and a jaw mouth formed by said fixed jaw and said movable jaw such that said jaw mouth has three or more clamping sides for holding a hexagonal nut or a bolt having a hexagonal head.

2. The adjustable wrench as defined in claim 1, wherein said receiving hole of said fixed jaw is provided with a guide portion; and wherein said movable jaw is provided with a position confining portion which slides along said guide portion at the time when said movable jaw is axially moved.

3. The adjustable wrench as defined in claim 2, wherein said guide portion is located in said third clamping side of said fixed jaw and is of a protruded construction; and wherein said position confining portion is located in a side of said second clamping side of said movable jaw and is of a recessed construction, said position confining portion being engageable with said guide portion.

4. The adjustable wrench as defined in claim 2, wherein said guide portion is located in said third clamping side of said fixed jaw and is of a recessed construction; and wherein said position confining portion is located in a side of said second clamping side of said movable jaw and is of a protruded construction, said position confining portion being engageable with said guide portion.

5. The adjustable wrench as defined in claim 2, wherein said position confining portion is located in a side of said first clamping side of said movable jaw and is a rail; and wherein said guide portion is located in said fourth clamping side of said fixed jaw and is a slide slot engageable with said position confining portion.

* * * * *